US007527242B2

(12) United States Patent
Shaha

(10) Patent No.: US 7,527,242 B2
(45) Date of Patent: May 5, 2009

(54) CEILING-MOUNTED ELEVATING STORAGE PLATFORM

(75) Inventor: Kevin B. Shaha, Laclede, ID (US)

(73) Assignee: Illinois Tool Works Inc., Glenview, IL (US)

( * ) Notice: Subject to any disclaimer, the term of this patent is extended or adjusted under 35 U.S.C. 154(b) by 1190 days.

(21) Appl. No.: 10/960,174

(22) Filed: Oct. 6, 2004

(65) Prior Publication Data

US 2006/0080904 A1 Apr. 20, 2006

(51) Int. Cl.
*B66D 1/36* (2006.01)

(52) U.S. Cl. ..... 254/286; 254/295; 254/296; 254/338; 187/263; 182/144; 182/150

(58) Field of Classification Search ..... 254/278, 254/286, 294, 295, 296, 338, 343; 187/263; 182/141, 142, 144, 150
See application file for complete search history.

(56) References Cited

U.S. PATENT DOCUMENTS

| | | | | | |
|---|---|---|---|---|---|
| 410,507 | A * | 9/1889 | Fain | 254/278 |
| 931,962 | A | 8/1909 | Rountree | |
| 1,085,607 | A | 2/1914 | Haynes | |
| 1,197,035 | A | 9/1916 | Knudtson | |
| 1,613,901 | A | 1/1927 | Parrish | |
| 1,655,562 | A * | 1/1928 | Powers | 182/131 |
| 1,703,424 | A | 2/1929 | Hoffman | |
| 1,736,723 | A | 11/1929 | Serra y Perez | |
| 4,600,177 | A * | 7/1986 | Fritz | 254/338 |
| 4,911,428 | A | 3/1990 | Wiece | |
| 5,871,070 | A | 2/1999 | Contreras | |
| 5,897,104 | A * | 4/1999 | Garbiso | 254/334 |
| 5,943,714 | A | 8/1999 | Dignam | |
| 6,105,938 | A * | 8/2000 | Koida | 254/278 |
| 6,131,702 | A | 10/2000 | Berridge | |
| 6,386,515 | B1 * | 5/2002 | Sachtleben | 254/338 |
| 6,507,962 | B2 | 1/2003 | Thurston | |
| 6,957,804 | B2 * | 10/2005 | Heggestad | 254/278 |
| 6,969,049 | B2 * | 11/2005 | Bilcik | 254/278 |
| 7,150,449 | B1 * | 12/2006 | Dueck et al. | 254/278 |
| 7,234,685 | B2 * | 6/2007 | Britten | 254/385 |
| 7,243,870 | B2 * | 7/2007 | Pook et al. | 242/278 |
| 7,325,785 | B2 * | 2/2008 | Krengel et al. | 254/338 |

* cited by examiner

*Primary Examiner*—Emmanuel M Marcelo
(74) *Attorney, Agent, or Firm*—Mark W. Croll; Christopher P. Rauch; Beem Patent Law Firm

(57) ABSTRACT

A storage facility has a frame having a pair of first and second opposed parallel spaced apart elongated frame elements. The frame members each include means for attaching the frame to a horizontal ceiling. A cable support element is positioned at each end of each frame member. An elongated rotatable shaft has a first end connected to an intermediate location on the first frame member, and a second end connected to an intermediate location on the first frame member. A drive mechanism is connected to the shaft to control the rotational position of the shaft. A number of cable portions each have a first end secured to a respective end portion of the shaft. Each cable portion has an intermediate portion received by a respective cable support member, and a free end extending downwardly from the support member. A platform is connected to and supported by the free ends of the cables, and operates to elevate or lower in response to rotation of the shaft by the drive mechanism.

20 Claims, 2 Drawing Sheets

CEILING-MOUNTED ELEVATING STORAGE PLATFORM

FIELD OF THE INVENTION

The invention relates to equipment storage, and more particularly to apparatus having elevation-adjustable platforms.

BACKGROUND OF THE INVENTION

Many homes and commercial facilities have limited usable storage space, and seek to increase storage within existing space. Typically, volumes of space are available in upper portions of garages, above vehicles and such, especially where there are high ceilings. However, shelving that might be installed to take advantage of this space would be difficult or dangerous to access, because of the need to carry heavy items up and down ladders.

Industrial storage solutions have provided platforms that are suspended by cables, and which are lifted simultaneously to keep the platform level. However, these are unsuitable for household use due to their size, weight, and complexity. Typically, such systems have large components that are impractical for a consumer to transport, or to ship to the consumer. Such industrial systems are generally delivered and installed professionally, or are assembled on site by skilled personnel. Such systems are not readily scaled to household use because of the configurations and designs employed.

SUMMARY OF THE INVENTION

The present invention overcomes the limitations of the prior art by providing a storage facility having a frame with a pair of first and second opposed parallel spaced apart elongated frame elements. The frame members each include means for attaching the frame to a horizontal ceiling. A cable support element is positioned at each end of each frame member. An elongated rotatable shaft has a first end connected to an intermediate location on the first frame member, and a second end connected to an intermediate location on the first frame member. A drive mechanism is connected to the shaft to control the rotational position of the shaft. A number of cable portions each have a first end secured to a respective end portion of the shaft. Each cable portion has an intermediate portion received by a respective cable support member, and a free end extending downwardly from the support member. A platform is connected to and supported by the free ends of the cables, and operates to elevate or lower in response to rotation of the shaft by the drive mechanism.

DETAILED DESCRIPTION OF A PREFERRED EMBODIMENT

Figure 1:
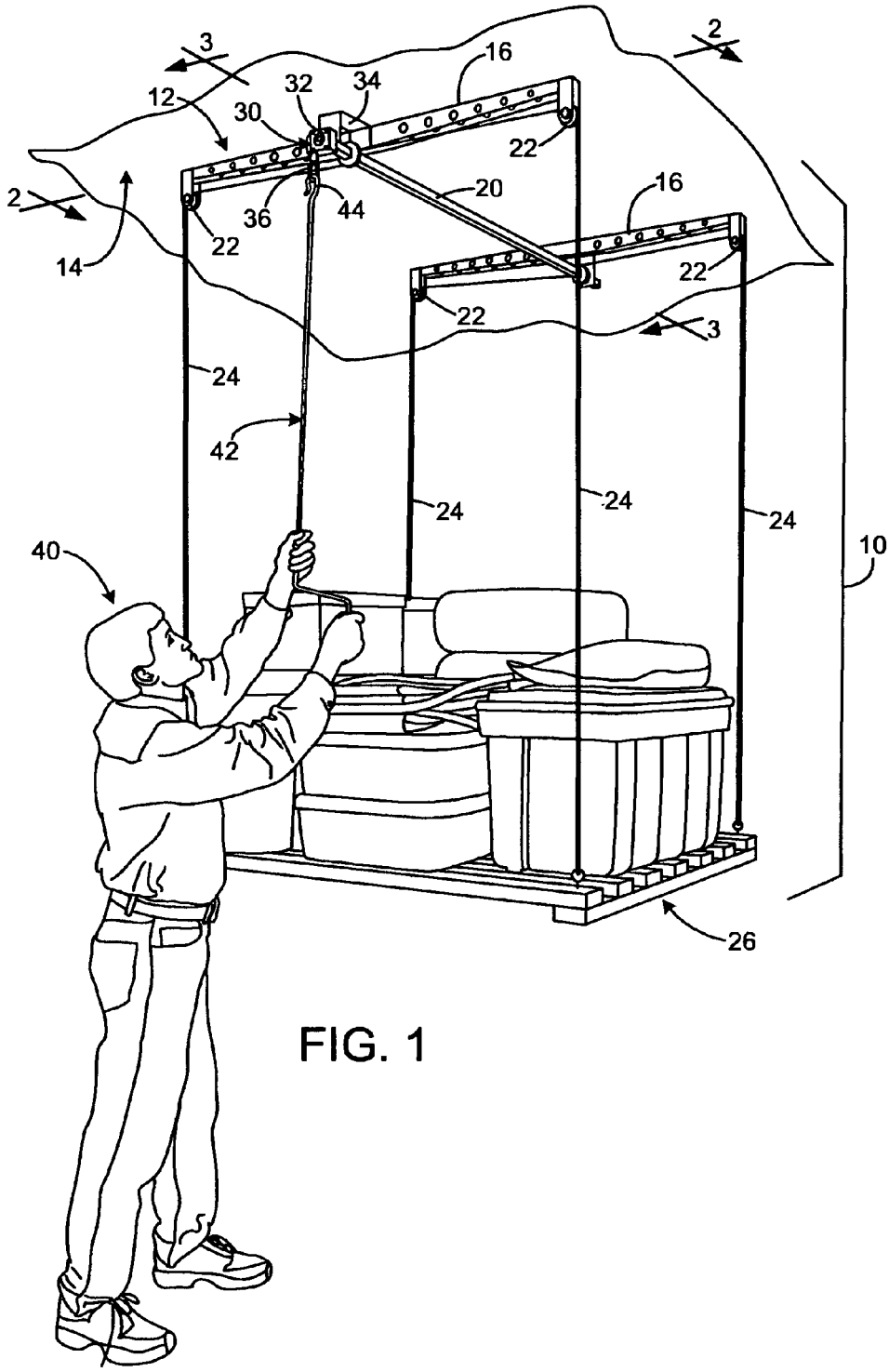
FIG. 1 is a perspective view of a ceiling-mounted elevating storage platform according to a preferred embodiment of the invention.

FIG. 1 shows a lifting facility 10 having a frame 12 mounted on a ceiling 14. The frame includes two parallel, spaced apart elongated channel members 16, a rotating shaft 20 spanning between the midpoints of the channels and secured to each for rotation. Each free end of each channel member includes a sheave or pulley wheel 22 the rotates on a horizontal axis oriented perpendicularly to the length of the channel. Four cables 24 are each wrapped about an end portion of the shaft at one end, and extend laterally from the shaft, over a respective sheave, and downward. The free ends of the cables are secured to respective corners of a platform 26 upon which goods are stored.

A gear box 30 is connected at one end of the shaft with a housing 32 secured via a bracket 34 to one of the channels. The gear box includes an internal mechanism to be discussed below, with an input element 36 protruding downwardly from the box. A operator 40 employs an elongated rod 42 that terminates with a hook 44 that engages a loop on the input element 36. Rotation of the rod causes the shaft to rotate, taking in or paying out the four cables, all at the same rate, causing the platform to remain level while raising or lowering.

Figure 2:
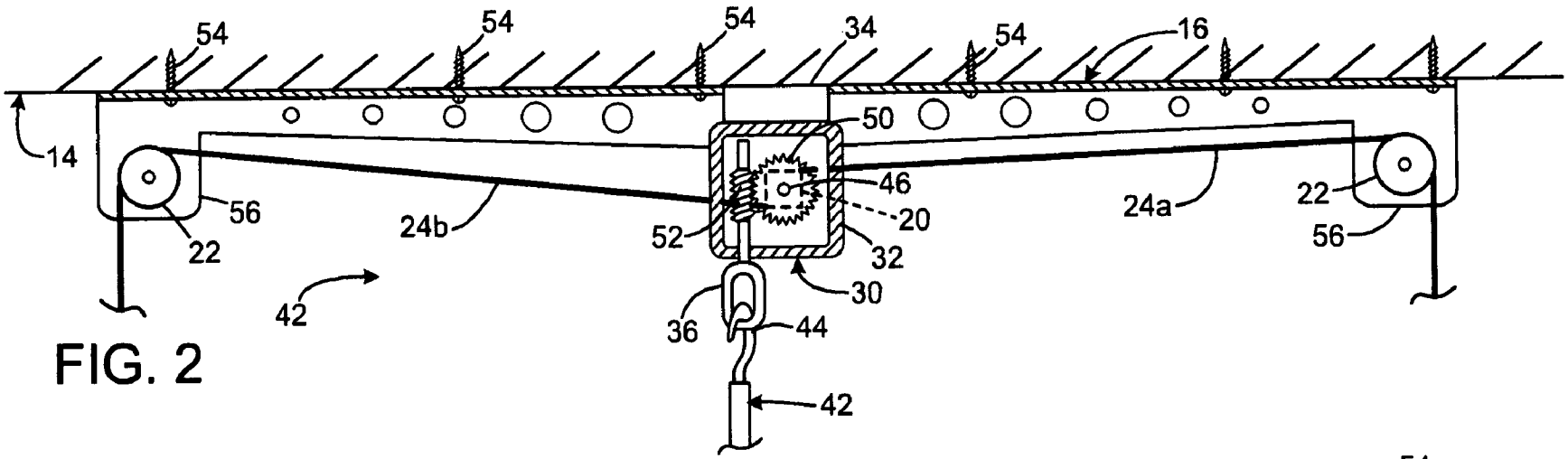
FIG. 2 is a sectional side view taken along line 2-2 of FIG. 1.

FIG. 2 shows the facility as viewed endwise along the axis 46 of the shaft 20. The gear box 30 is a worm gear mechanism, with a spur gear 50 engaged to the shaft and free to rotate within the gear box, with apertures serving as bushings to support the gear and shaft. Note that the bushing need support only the relatively light weight of the shaft, as the load carried by the cables is balanced, and supported by the sheaves and transferred to the frame channels and ceiling. A worm gear 52 is oriented on a vertical axis, and engages the spur gear. The loop or eye forming the input element 36 extends downwardly from the gear box, so that it may be accessed by the hook 44.

Preferably, the gear box is as close to the ceiling as practical, and the input element 36 extends only a limited distance below the gear box, so that it does not interfere with goods on the platform when the platform is raised, or reduce headroom in the room. In the preferred embodiment the eye protrudes only 6 inch from the ceiling. The spur gear has numerous teeth, so that a comparable number rotations of the eye are needed to achieve one rotation of the shaft. This provides a gear ratio that is typically the low ratio of a worm gear drive. This also ensures that the shaft can not rotate spontaneously from a load on the platform, and is locked in place due to the inherent friction and geometry of the gear mechanism. Other mechanisms providing similar frictional locking may be substituted in alternative embodiments to provide safe operation and storage.

A first cable 24*a* is secured to the shaft near one end of the shaft, and loops over the shaft so that it is paid out when the shaft rotates clockwise as viewed in FIG. 2. A second cable 24*b* extends in the opposite direction, and is looped under the shaft to pay our and take up in synchrony with cable 24*a*. The portion of the shaft that is covered by the wound cable may referred to as the spool portion. Each cable passes over a respective sheave wheel 22, and extends downward to a respective platform corner. When the system is under load, the cables each bear a substantial portion of the load, which generates downward and medial force on the sheaves. The downward force is transferred to the ceiling by screws 54 that pass through holes in the horizontal upper portions of the channels. The medial load generates lengthwise compression in the robust channel member 16. Because of the limited radius and lever arm of the shaft, the torque applied to the shaft is limited, and is readily withstood by the worm gear. The cables associated with the opposite channel member operate identically, so that the platform remains level in all conditions of shaft rotation.

Figure 3:
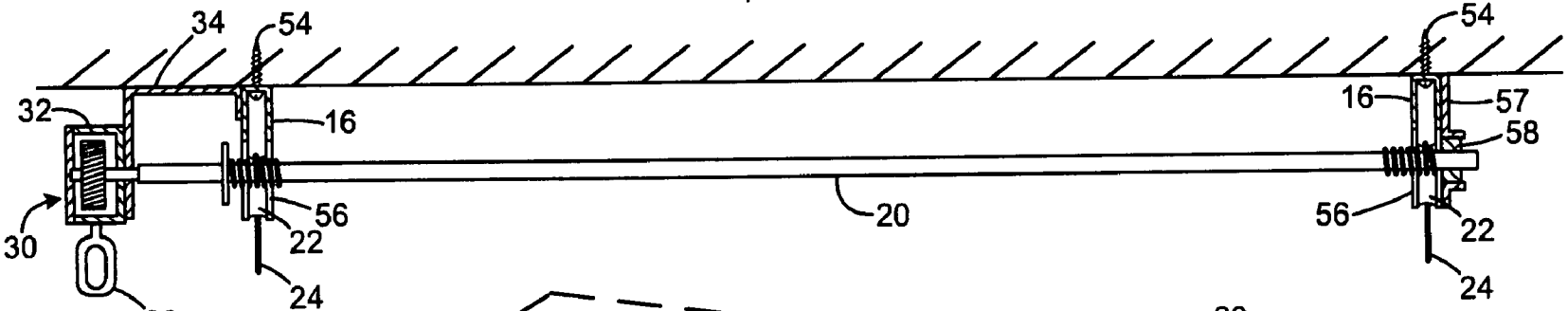
FIG. 3 is a sectional side view taken along line 3-3 of FIG. 1.

FIG. 3 shows a side view from the ends of the channels 16. The channels are shown to have a downwardly-facing U-shaped cross section, so that the base is flush against the ceiling, and the sides provide strength. End lobes 56 support the sheaves 22 so that they are adequately spaced apart from the ceiling. The cables are shown partially wound about the shaft, and the illustration shows the substantial available space on the length of the shaft for the cable to neatly and closely wind about the shaft. Because the sheaves are relatively distant from the shaft, the cable tends to wind neatly due because it remains close to perpendicular to the shaft even when the cable is fully wound. A bracket 57 connected to the right channel (other than the gear box-supporting channel) rotatably supports a bracket 57 that has a sleeve supporting a round bushing that is mounted on the shaft end away from the gear box. This provides vertical and lateral support to the shaft.

In the preferred embodiment, the shaft is 1 inch wide on each side, so that accounting for the nearly circular wrap by the relatively stiff cable, and for the cable thickness, about 5.25 inch of cable length is taken up in a single turn of the shaft. In a typical application with 7 feet of vertical lift travel, this requires 16 rotations of the shaft, With a cable thickness of ¼ inch (noting that two cables are wound side by side) 8 inches of the shaft will be covered by a single neat layer of cable on each end. With the channels having a length of 48 inch, that provides a limited angle of about 18 degrees between the cable and the shaft when fully wound, which is small enough to ensure that the cable winds levelly.

Figure 4:
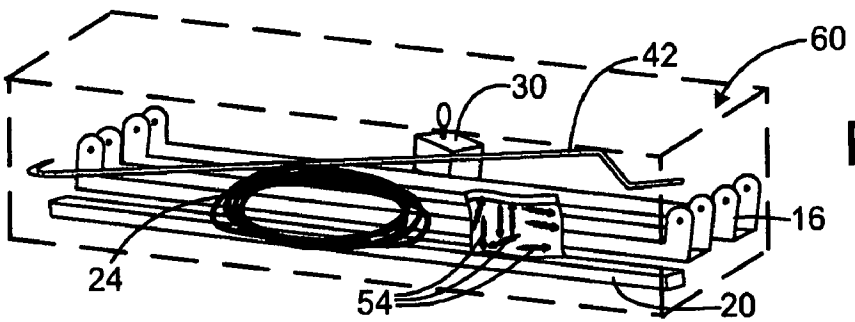
FIG. 4 is a perspective view illustrating the system of FIG. 1 in unassembled kit for as packed for shipping.

FIG. 4 shows the facility as stored and shipped in a shipping carton 60. Because each of the major components is elongated with a limited width and girth, the carton may also be slim and elongated. This avoids concerns associated with structural frames that have significant length and width, such as if the frame were preassembled in a rectangular or H shape. In addition, the platform is formed of elongated plank that may be shipped in a similar slim elongated carton. IN al alternative embodiment, the system may be provided with a metal platform, such as assembled of elongated components. Alternatively, the facility may be provided without a platform, so that the user may provide his own desired platform.

While the disclosure is made in terms of a preferred embodiment, the invention is not intended to be so limited.

The invention claimed is:

1. A storage facility comprising:

a frame having four corners;

the frame including attachment means for fixedly attaching the frame to a horizontal ceiling;

a shaft journaled for rotation with respect to the frame;

the shaft extending across the frame, and having a respective spool portion at each end of the shaft;

the spool portions each being positioned proximate to an edge of the frame generally between a respective adjacent pair of the corners;

a cable support element at each corner of the frame;

a plurality of cable portions, each having a first end secured to a respective spool portion;

each cable being received by a respective cable support member and having a free end extending downwardly therefrom;

a platform connected to and supported by the free ends of the cables; and adjustment means connected to the shaft for rotating the shaft to change the elevation of the platform.

2. The storage facility of claim 1 wherein the frame comprises a pair of parallel spaced apart elongated frame elements, with the cable support elements arranged at opposite ends of the frame elements, and wherein the shaft is oriented perpendicularly to the frame elements to span therebetween.

3. The storage facility of claim 2 wherein the shaft is positioned at a mid-line of the frame elements.

4. The storage facility of claim 2 wherein each spool portion is positioned at a mid-point between a respective pair of cable support elements.

5. The storage facility of claim 1 wherein the spool portions are widely spaced apart at opposite ends of the shaft.

6. The storage facility of claim 1 wherein the cable support elements are wheels rotatably mounted to the frame.

7. The storage facility of claim 1 wherein the four corners of the frame define a rectangle.

8. The storage facility of claim 1 wherein the platform is oriented parallel to the frame.

9. The storage facility of claim 1 wherein the adjustment means comprises a gear linkage.

10. The storage facility of claim 9 wherein the gear linkage has a rotatable input element operably engaged to the shaft with a low drive ratio that requires a plurality of rotations of the input element to generate a rotation of the shaft.

11. The storage facility of claim 10 wherein the drive ratio is below a preselected threshold that provides that the platform remains at a selected elevation when the input element is free to rotate.

12. The storage facility of claim 9 wherein the gear linkage has a rotatable input element including a worm gear that engages a spur gear connected to the shaft.

13. The storage facility of claim 1 wherein the adjustment means includes a rotatable input element operably engaged to the shaft, and wherein the input element is positioned adjacent to the frame and to a ceiling surface to which the frame is attached, such that the input element does not protrude substantially from the ceiling.

14. The storage facility of claim 1 wherein the adjustment means includes a worm gear drive.

15. The storage facility of claim 1 wherein the frame comprises two separate spaced apart elongated elements.

16. A storage facility comprising:

a frame having a pair of first and second opposed parallel spaced apart elongated frame members;

the frame members each including attachment means for fixedly attaching the frame to a horizontal ceiling;

a cable support element at each end of each frame member;

an elongated rotatable shaft having a first end connected to an intermediate location on the first frame member, and a second end connected to an intermediate location on the first frame member;

a drive mechanism connected to the shaft to control the rotational position of the shaft;

a plurality of cable portions, each having a first end secured to a respective end portion of the shaft, each having an intermediate portion received by a respective cable support member, and each having a free end extending downwardly therefrom; and a platform connected to and supported by the free ends of the cables.

17. The storage facility of claim 16 wherein the shaft is the only element spanning between the spaced-apart frame members.

18. The storage facility of claim 16 wherein the drive mechanism has a selected gear ratio operable to prevent the platform from descending in response to weight on the platform, except when an input element on the drive mechanism is deliberately rotated.

19. The storage facility of claim 16 wherein the drive mechanism includes a worm gear drive.

20. The storage facility of claim 16 wherein the elongated elements of the facility each have a limited girth, and the other elements have a limited size, such that the facility may be stored and transported as a kit in an elongated carton with limited girth.

* * * * *